US010358237B2

(12) United States Patent
Mirabella et al.

(10) Patent No.: US 10,358,237 B2
(45) Date of Patent: Jul. 23, 2019

(54) COVERING AND METHOD OF USING THE SAME

(71) Applicant: Q Sales & Leasing, LLC, Hazel Crest, IL (US)

(72) Inventors: Peter W. Mirabella, Schererville, IN (US); Sesar De La Torre, Posen, IL (US)

(73) Assignee: Q Sales & Leasing, LLC, Hazel Crest, IL (US)

( * ) Notice: Subject to any disclaimer, the term of this patent is extended or adjusted under 35 U.S.C. 154(b) by 1045 days.

(21) Appl. No.: 13/872,846

(22) Filed: Apr. 29, 2013

(65) Prior Publication Data

US 2013/0283737 A1 Oct. 31, 2013

Related U.S. Application Data

(60) Provisional application No. 61/639,723, filed on Apr. 27, 2012.

(51) Int. Cl.

| | |
|---|---|
| ***B65B 11/00*** | (2006.01) |
| ***B65D 71/00*** | (2006.01) |
| ***B65D 81/38*** | (2006.01) |
| *A47B 81/00* | (2006.01) |

(52) U.S. Cl.

CPC ..... *B65B 11/00* (2013.01); *B65D 71/0088* (2013.01); *B65D 81/3888* (2013.01); *A47B 81/00* (2013.01); *B65D 2313/02* (2013.01)

(58) Field of Classification Search

CPC ..... A47F 5/00; B65B 11/00; A47B 81/00; B65D 81/3888; B65D 71/0088; B25H 5/00; B62D 33/00; B62D 33/04

See application file for complete search history.

(56) References Cited

U.S. PATENT DOCUMENTS

| | | | | |
|---|---|---|---|---|
| 3,088,619 A * | 5/1963 | Boucher | ..... | A44B 19/16 206/386 |
| 3,837,379 A * | 9/1974 | McDonald, Jr. | .... | A61M 3/0241 137/408 |
| 4,927,317 A * | 5/1990 | Acosta | ..... | B09B 1/004 212/259 |
| 6,237,361 B1 | 5/2001 | Broussard | | |

(Continued)

OTHER PUBLICATIONS

Blueye, Ultra Light Protective Blanket, Ideal for Perishable Shipments (1 page).

(Continued)

*Primary Examiner* — Michelle Lopez
*Assistant Examiner* — Chinyere J Rushing-Tucker
(74) *Attorney, Agent, or Firm* — McCracken & Gillen LLC

(57) ABSTRACT

A method of preparing goods for transport is disclosed. A covering for the goods is provided that includes a wrap portion removably carried by a storage rack and a cap portion removably attached to the wrap portion, wherein the cap portion includes an attachment member. A force transmission member is secured to the attachment member of the cap portion and the cap portion is removed from the wrap portion. The force transmission member is moved to position the cap portion atop the goods. The wrap portion is removed from the storage rack, wrapped about the goods, and secured to the cap portion.

22 Claims, 13 Drawing Sheets

(56) References Cited

U.S. PATENT DOCUMENTS

| | | | | |
|---|---|---|---|---|
| 6,478,061 | B2 * | 11/2002 | Haberkorn | B60P 3/20 206/494 |
| 6,723,401 | B1 * | 4/2004 | McKnight | A41D 19/01523 428/213 |
| 6,976,595 | B1 * | 12/2005 | Geller | A47F 5/0838 211/124 |
| 2002/0149225 | A1 * | 10/2002 | Hornady | B60P 7/04 296/100.01 |
| 2005/0269278 | A1 * | 12/2005 | Gipson | B25H 5/00 211/86.01 |
| 2006/0130428 | A1 * | 6/2006 | Han | B65B 9/13 53/241 |
| 2011/0258972 | A1 * | 10/2011 | Kenneally | B65D 19/38 220/592.2 |
| 2011/0316301 | A1 * | 12/2011 | Mirabella | B60R 13/01 296/39.1 |
| 2012/0090272 | A1 * | 4/2012 | Benetri | A61C 13/0022 53/461 |
| 2012/0193354 | A1 * | 8/2012 | Cavenagh | B65D 88/1612 220/9.3 |
| 2013/0247606 | A1 * | 9/2013 | Suchecki | F25D 3/08 220/592.2 |
| 2014/0117296 | A1 * | 5/2014 | Shrader | B66F 9/18 254/278 |
| 2015/0048289 | A1 * | 2/2015 | Cornew | B60J 11/00 254/394 |

OTHER PUBLICATIONS

AMSAFE, K2429, Miscellaneous Test Report, TG0005-07, Nov. 30, 2010, Doc. No. MTR 10/185, Issue 1, Thermal Performance Validation of the AMSAFE Standard Thermal Blanket Assembly (61 pages—2 pdf files).

The coldbox.com, Climate Controlled Containers Inc., RPS—Series Refrigerated Palletized Shipper or Cold Box (2 pages).

thecoldbox.com, Climate Controlled Containers Inc., Product Specifications, http://climatecontrolledcontainers.com/?page_id=121, printed May 23, 2013 (2 pages).

CRYOPAK, Healthcare Packaging, Cold Chain Chronicles, Challenges and Solutions for the Cold Chain (4 pages).

CSAFE, AcuTemp® SVS, Mobile Temperature Management Unit, www.CSafeLLC.com (1 page).

Greenbox Systems, Thermal Management System, It takes Complicated Science to make something this uncomplicated, http://www.greenboxsystems.com/options.htm?submit=View+the+options (1 page).

INTELSIUS™, Pharmatherm 2-8° C. Pallet Sized Systems, Intelsius.com (1 page).

INTELSIUS™, Pharmatherm Pallet Dry Ice Shippers, Intelsius.com (1 page).

Military Logistics Forum, The Publication of Record for the Military Logistics Community, www.MLF.kmi.com, Jul. 2011, vol. 5, Issue 6 (2 pages).

Bonar Plastics, Polar Insulated Containers, PB11HL, PB11HLC (1 page).

Bonar Plastics, Polar Insulated Containers, The Polar® Insulated Container System Dry Ice, Experience the "POLAR" Difference, www.bonarplastics.com (4 pages).

POWERBLANKET, Cold Weather Got you Stuck?, www.powerblanket.com (6 pages).

ZONEWORKS, Insulated Pallet Cover, www.zoneworks.com (1 page).

TP3 Global Ltd., Silverskin™ Thermal Covers, Silver Skin™ Specification Sheet PP100/PH300/P8500, Copyright 2013 TP3 Global Ltd., Doc. Feb. 2013, www.tp3global.com (2 pages).

SOFRIGAM, Product Catalog ( pp. 1-23), www.sofrigam.com (12 pages).

Pratt Industries (USA), Laboratory Test Report Wichita Tech Center, Test Report No. T2M90036, Test Date Feb. 10, 2009, Test File No. MTI-T2M90036 LIN—Cold Pack Insulation, http://www.millertechintl.com./testresults_files/sheet001.htm, printed May 15, 2013 (3 pages).

TP3 Global Ltd., Silverskin™ Thermal Covers, TP3 Global Ltd, Summary Test Report, Full Size Pallet, SilverSkin PH300, Full Mass, Copyright 2013 TP3 Global Ltd., www.tp3global.com (4 pages).

* cited by examiner

COVERING AND METHOD OF USING THE SAME

CROSS-REFERENCE TO RELATED APPLICATIONS

This application claims the benefit of U.S. Provisional Patent Application No. 61/639,723, filed Apr. 27, 2012, which is hereby incorporated herein in its entirety.

BACKGROUND OF THE INVENTION

1. Field of the Invention

This invention relates to a covering that is placed over goods in preparation for shipping and method of using the same.

2. Description of the Background of the Invention

The transportation or shipment of goods is a complex and costly process that includes many actors, including shippers, manufacturers, wholesalers, and retailers. During shipping, some goods require added protection to keep them from being damaged while other goods need to be kept at or near a constant temperature, i.e., cold products kept cold and hot products kept hot. One method of shipping fragile goods includes the use of extra packing materials such as bubble wrap, which is discarded once the goods are delivered. In addition, a common method of transporting temperature sensitive items is the use of trucks with refrigerated or heated trailers. The use of additional packing materials and special trucks results in added costs, which are ultimately passed on to the consumer. Furthermore, many of the existing devices that are used to insulate goods cannot be readily adjusted to fit pallets of goods that vary in height, length, and width. Additionally, many existing devices are cumbersome and cannot be placed on a pallet of stacked goods efficiently by a single person and/or require the use of ladders and other similar devices. For theses reasons, a reusable, adjustable, insulated covering that can be easily and efficient placed on a stack of temperature sensitive items in preparation for shipping would be an important improvement in the art.

DETAILED DESCRIPTION OF THE PREFERRED EMBODIMENTS

Figure 1A:
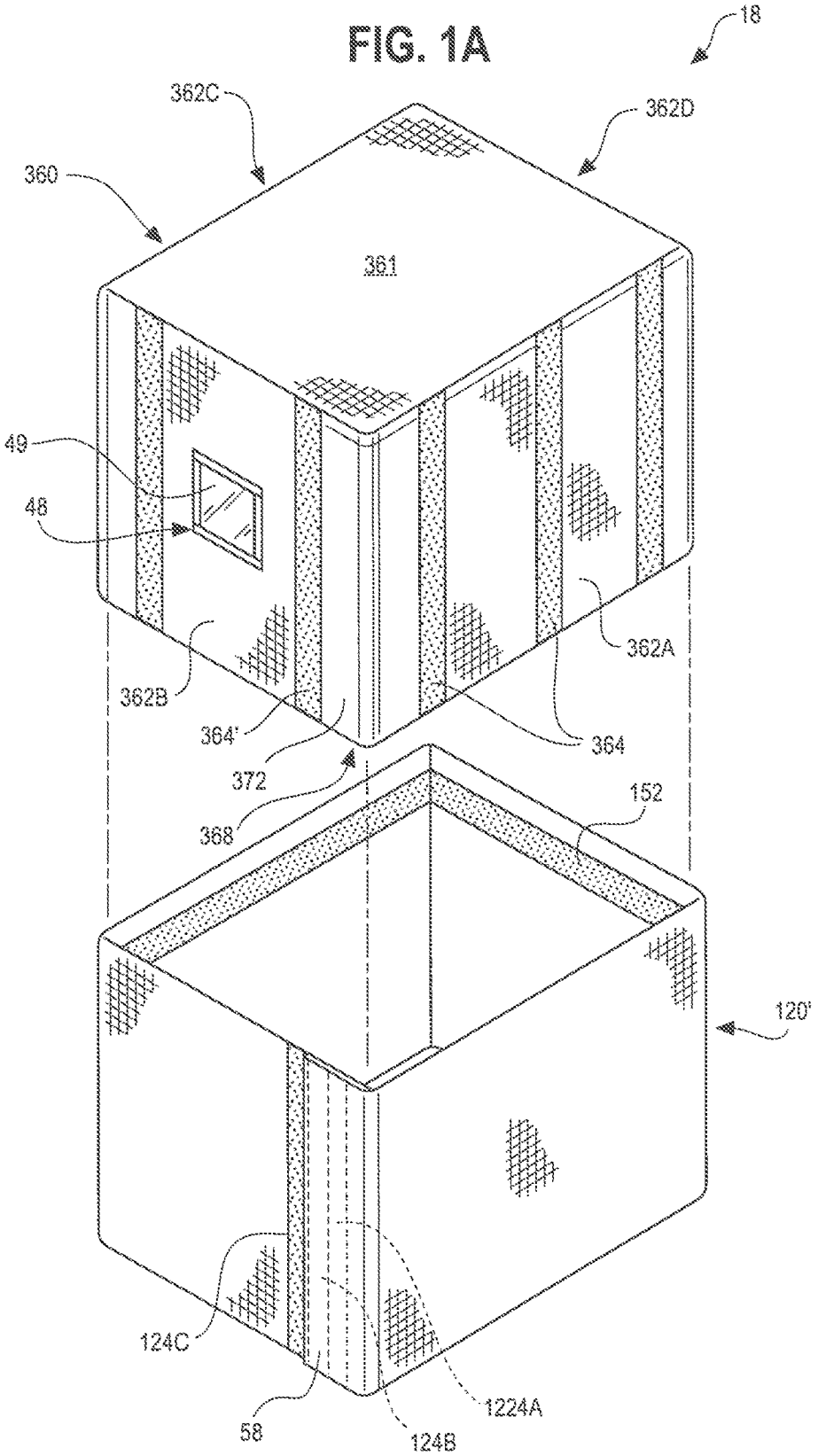
FIG. 1A is an isometric view of one embodiment of the cap and wrap portions of a covering.
Figure 1B:
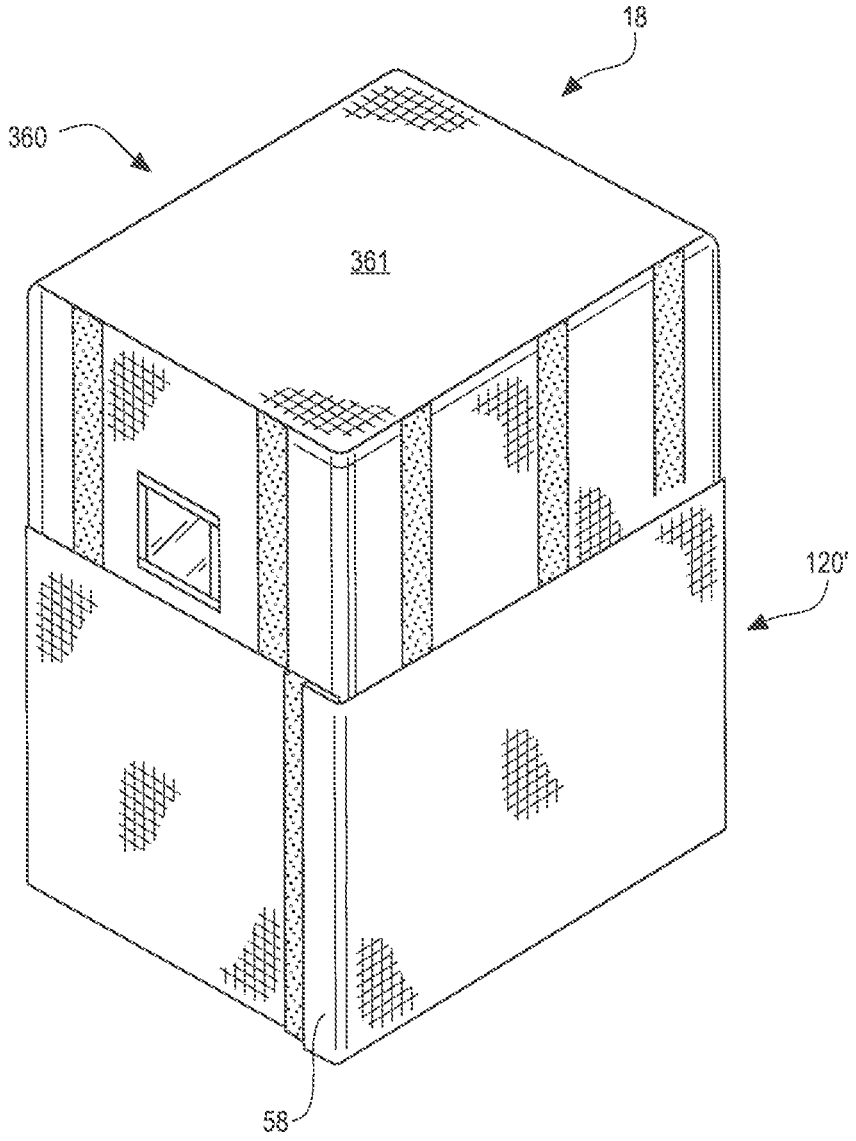
FIG. 1B is an isometric view of the cap and wrap portions of FIG. 1A assembled.

Disclosed is a thermal insulated covering comprising a cap and wrap portion for use in providing temperature protection for goods in transit. FIGS. 1A and 1B show an isometric view of one embodiment of a covering 18. FIG. 1A illustrates a wrap portion 120' and a cap portion 360 of the covering 18, and FIG. 1B shows the wrap portion 120' attached to the cap portion 360.

Figure 2:
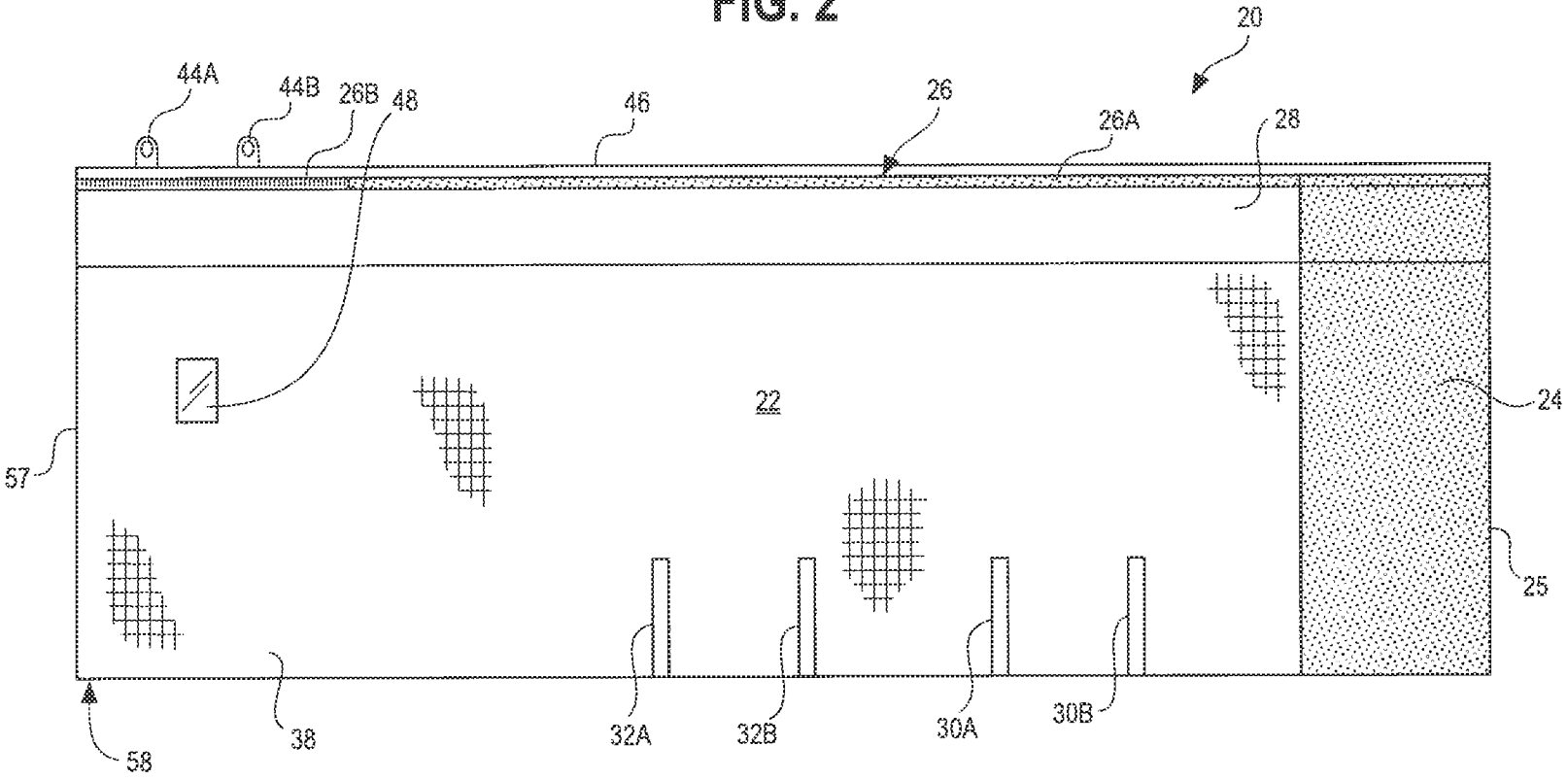
FIG. 2 is an elevational view of an exterior side of a wrap portion of another embodiment of the covering.

FIG. 2 illustrates another embodiment of the covering 18 having a wrap portion 20 with an exterior side 22. The exterior side 22 of the wrap portion 20 contains a vertical strip of loop fasteners 24 that extends down the height of the exterior side adjacent a first end portion 25. A person of ordinary skill in the art would understand that hook fasteners and loop fasteners make up one type of fastener (i.e., a hook and loop fastener), and that the parts are interchangeable. Furthermore, any type of fastener that has a male and female portion, e.g., a snap button, could be used in place of the hook and loop fasteners without departing from the spirit and scope of the present invention.

Figure 4:
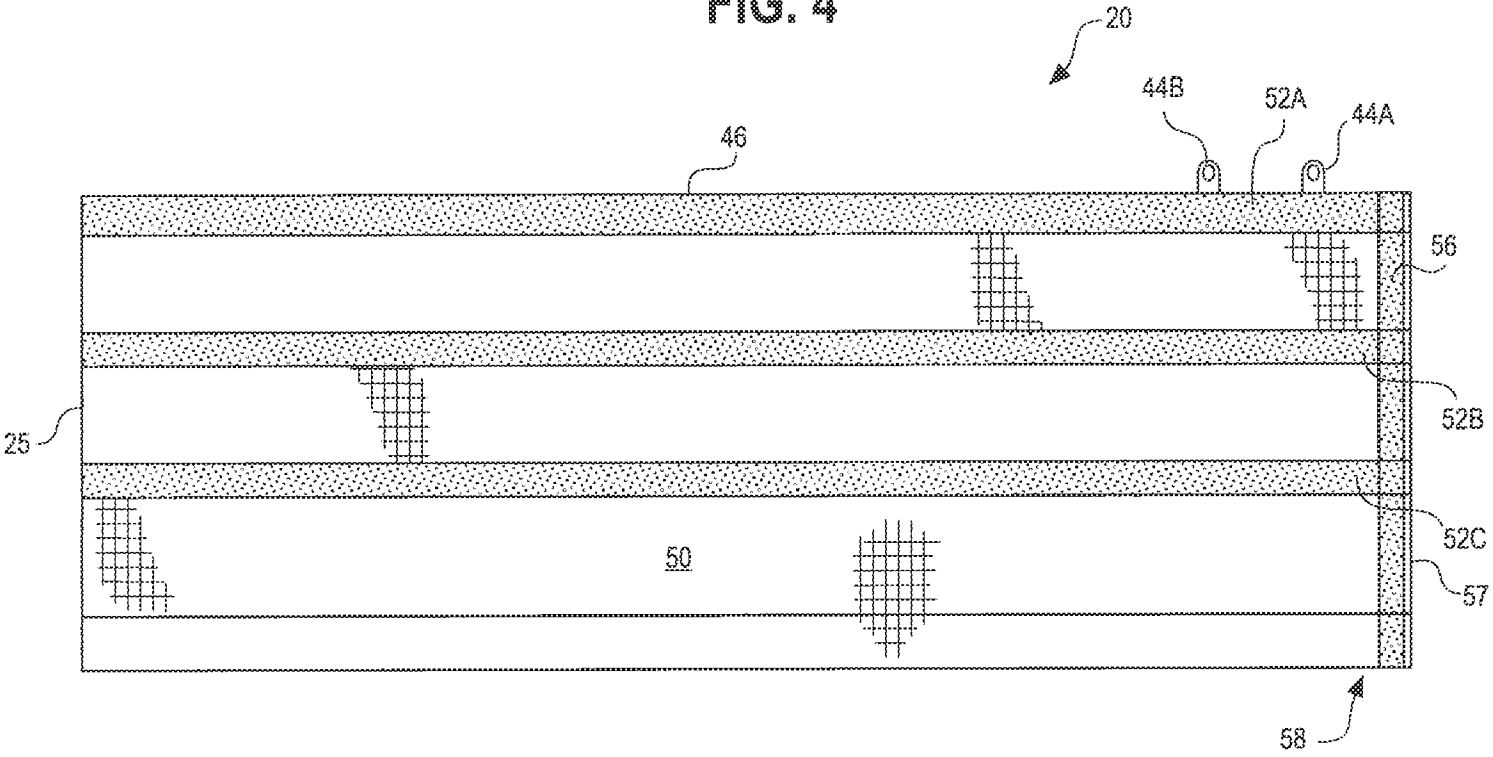
FIG. 4 is an elevational view of an interior side of the wrap portion of the covering of FIG. 2.

The vertical strip of loop fasteners 24 will be mated with vertical band of hook fasteners 56 contained on the interior side 50 of the wrap portion 20 as shown in FIG. 4. The exterior side 22 also contains a horizontal strip of both hook and loop fasteners 26 on a top portion 28 that extends the length of the wrap portion 20. Horizontal loop portion 26A of the horizontal strip 26 has a color that is different from that of the hook portion 26B. For example, horizontal loop portion 26A could be red and horizontal hook portion 26B could be black. The purpose of the different coloring is to indicate to a user when to start folding the wrap portion 20 when the wrap portion is being removed from a cap portion 60, 160, 260, or 360 each of which is discussed in more detail below.

Figure 3:
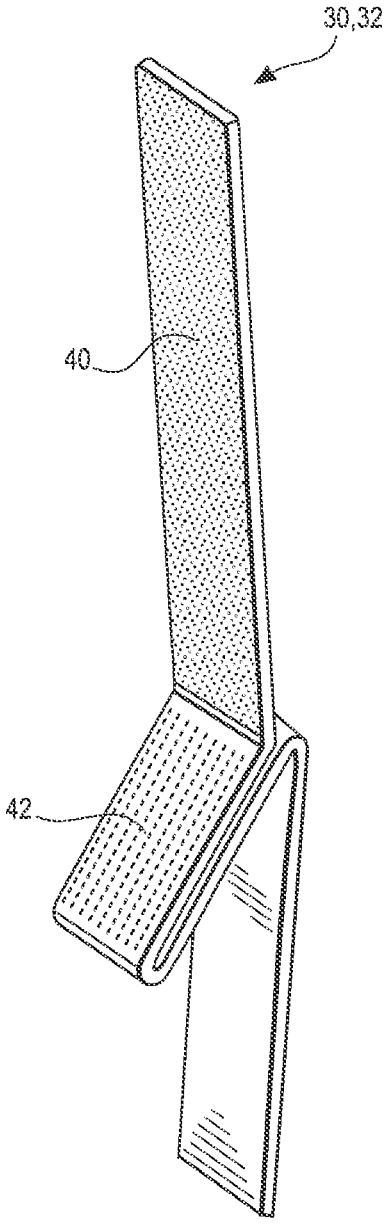
FIG. 3 is an isometric close-up view of a lift strap portion disposed on the exterior side of the wrap portion of FIG. 2.

The exterior side 22 of the wrap portion 20 further contains two sets of lift straps 30A, B and 32A, B on a bottom portion 38. When wrap portion 20 is wrapped about a pallet of stacked goods, the lift straps 30A, B are disposed on a first side of the pallet of stacked goods and lift straps 32A, B are disposed on a second side of the pallet of stacked goods adjacent to the first side of the pallet of stacked goods. An enlarged view of the lift straps 30, 32 is shown in FIG. 3. The two sets of lift straps 30A, B and 32A, B enable a user to lift and secure the bottom portion 38 of the wrap portion 20 to prevent the bottom portion 38 from interfering or becoming damaged by the fork of a forklift, when the wrapped pallet of stacked goods is moved. As shown in FIG. 3, the lift straps 30, 32 comprise an attachment portion 40 that is covered with loop fasteners and a tab 42 that is covered on one side with hook fasteners. To raise the bottom portion 38 of the wrap portion 20, the tab 42 is pulled up and pressed against the attachment portion 40 thereby mating the hook fasteners of the tab 42 with the loop fasteners on the attachment portion 40.

The exterior side 22 also has two loops 44A, B attached to a top edge 46. In one embodiment, the loops 44A, B are made of plastic. The two loops 44A, B are used to store the wrap portion 20 on a storage rack 300 (discussed in more detail below). A pocket 48 with a transparent window 49 may also be included on the exterior side 22 of the wrap portion 20. The pocket 48 is used to hold shipping document concerning the pallet of stacked goods covered by the covering 18 and the transparent window 49 enables a user to easily view the shipping documents.

FIG. 4 shows the interior side 50 of the wrap portion 20. The interior side 50 contains three horizontal bands of hook fasteners 52A, B, C that extend the length of the interior side 50. Horizontal band 52A is located adjacent to the top edge 46, horizontal band 52B is located below horizontal band 52A, and horizontal band 52C is located below horizontal band 52B. The horizontal bands of hook fasteners 52A, B, C are used to attach the wrap portion 20 to the cap portion 60, 160, 260, or 360. The horizontal bands of hook fasteners 52 are located at varying vertical distances to enable the wrap portion 20 to be used with pallets of stacked goods of varying vertical heights. For example, if a high (e.g., seven feet), pallet of stacked goods is to be wrapped, then horizontal band 52A would engage the cap portion 60. Likewise, if the pallet of stacked goods is on the shorter side (e.g., 4 feet), then the horizontal band 52C would be used to engage the cap portion 60, 160, 260, or 360.

The interior side 50 of the wrap portion 20 also has a vertical band of hook fasteners 56 that extends the height of the interior side 50 adjacent a second end portion 57. The vertical band of hook fasteners 56 engages the vertical strip of loop fasteners 24 of the exterior side 22 when the wrap portion 20 is wrapped about a pallet of stacked goods thereby securing the wrap portion 20 around the goods. The wrap portion 20 is therefore long enough to completely cover each of the four sides of a pallet of goods and has a flap 58 that overlaps a portion of the wrap portion 20 located on the first side of the pallet of goods when the wrap portion 20 is wrapped about the pallet of stacked goods (see also FIGS. 1A and 1B with respect to wrap portion 120' and FIG. 7 with respect to wrap portion 120). Furthermore, the extension of the strips and bands of hook and loop fasteners, 24, 52, and 56, along the height and length of the interior and exterior of the wrap portion 20 enables the wrap portion 20 to be used with pallets of goods of varying heights, widths, and lengths.

Figure 5:
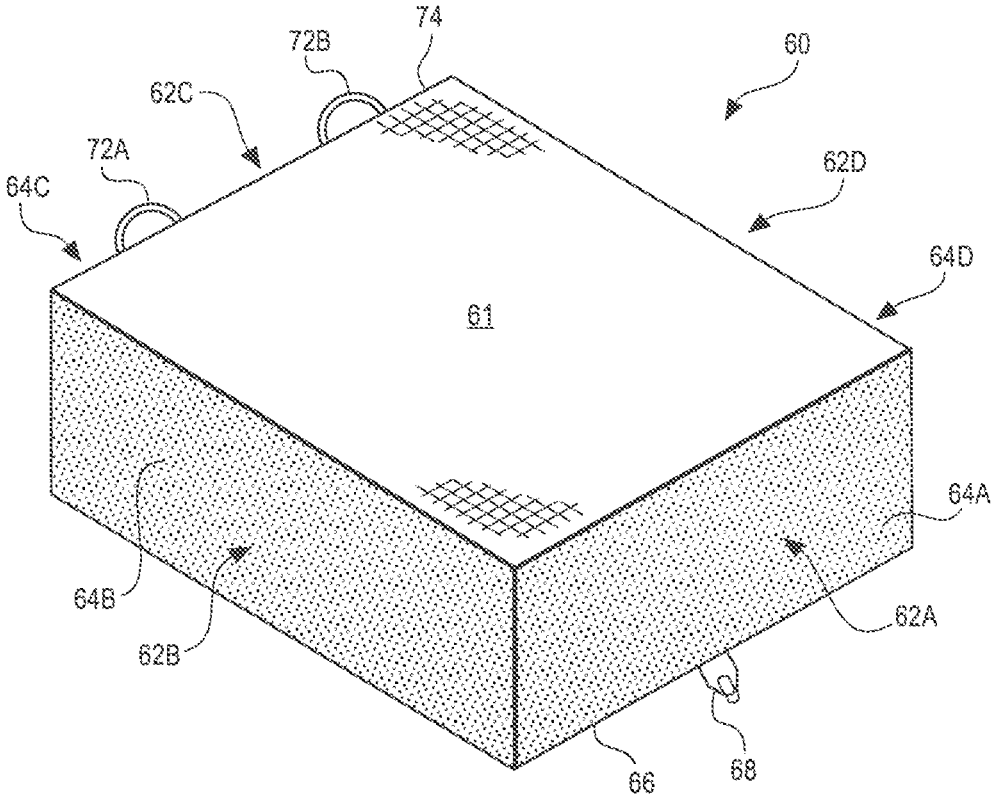
FIG. 5 is an isometric view of one embodiment of the cap portion of the covering.
Figure 6A:
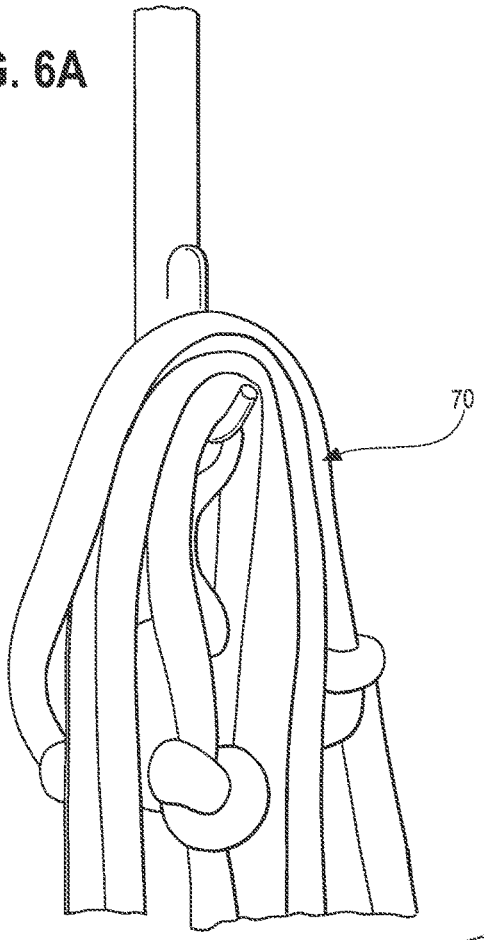
FIG. 6A and FIG. 6B are views of a pull cord stored on a storage rack.
Figure 6B:
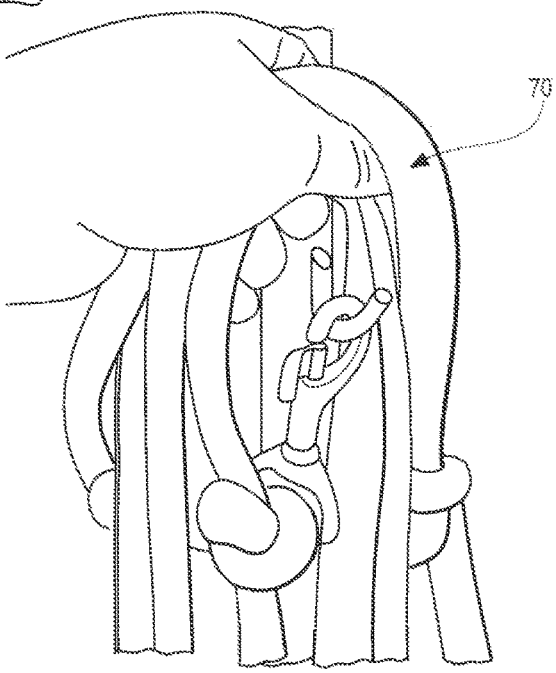

FIG. 5 shows another embodiment of the covering 18 having a cap portion 60. The cap portion 60 has a top 61 and four sides 62A, B, C, D (side 62C is a mirror image of side 62A and side 621) is a mirror image of side 62B). Sides 62A, B, C, D are covered with loop fastener portions 64A, B, C, D, which engage horizontal bands 52A, B, or C of the interior side 50 of the wrap portion 20 to secure the wrap portion 20 to the cap portion 60. A bottom edge 66 of side 62A contains a pull cord loop 68. The pull cord loop 68 on the cap portion 60 is used in conjunction with a pull cord 70 (as shown in FIGS. 6A and 6B) when the cap portion 60 is to be placed on a pallet of stacked goods that are stacked relatively high. In addition, two handles 72A, B are located on upper edge 74 of side 62C, which is disposed opposite to side 62A. The two handles 72A, B are provided to assist the user with placing the cap portion 60 on and removing the cap portion 60 from the pallet of stacked goods.

Figure 7:
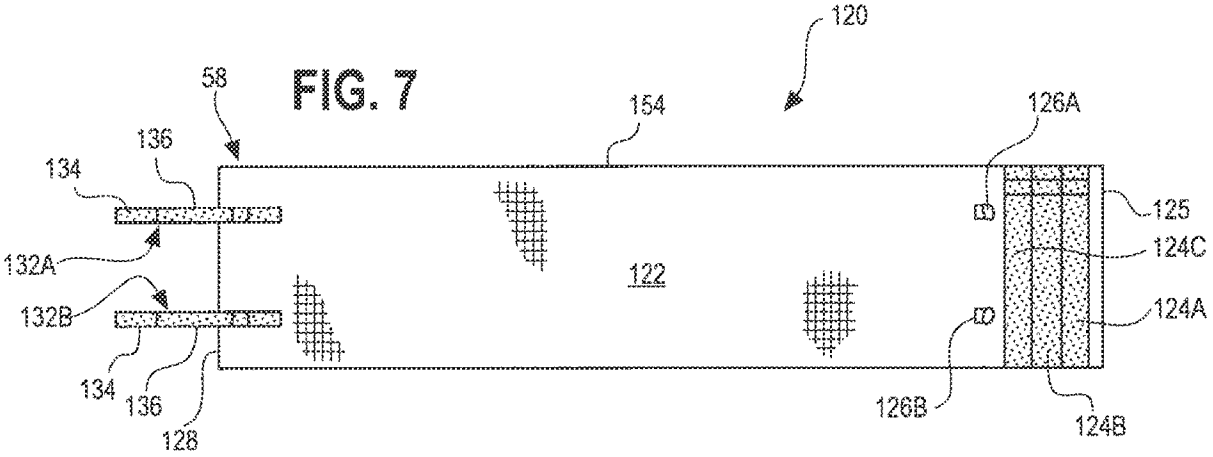
FIG. 7 is an elevational view of another embodiment of an exterior of the covering.

FIG. 7 shows a further embodiment of the covering 18 having a wrap portion 120. The wrap portion 120 has an exterior side 122. The wrap portion 120 has three vertical strips of loop fasteners 124A, B, C that extend the height of the wrap portion 120 and are disposed adjacent to each other and adjacent a first end portion 125. One or more of the vertical strips of loop fasteners 124A, B, C are mated with the vertical ribbon of hook fasteners 156 contained on the interior side 150 of the wrap portion 120 when the wrap portion 120 is wrapped about the pallet of stacked goods. Also, disposed adjacent the vertical strips of loop fasteners 124A, B, C, opposite the first end portion 125, are a pair of steel rings 126A, B. The steel rings 126A, B are used along with attachment straps 132A, B (discussed below) to more firmly attach the wrap portion 120 around the pallet of stacked goods.

The horizontal attachment straps 132A, B are attached to and extend away from a second end portion 128 of the wrap portion 120. The second end portion 128 of the wrap portion 120 is disposed opposite the first end portion 125. The attachment straps 132A, B comprise a portion of hook fasteners 134 and a portion of loop fasteners 136. When the wrap portion 120 is wrapped about a pallet of stacked goods, attachment strap 132A is passed through corresponding steel ring 126A and attachment strap 132B is passed through corresponding steel ring 126B. The portion of hook fasteners 134 of each attachment strap 132A, B is then folded back about steel ring 126A, B, respectively, so that the portion of hook fasteners 134 of each attachment strap 132A, B is mated with the portion of loop fasteners 136 of each strap 132. The addition of the steel rings 126A, B and the attachment straps 132A, B provides a tighter fit of the wrap portion 120 around the pallet of stacked goods. A tighter fit of the wrap portion 120 around the goods on the pallet, enables a user to use less shrink-wrap or other packing material to hold the goods together during transport.

The wrap portion 120' shown in FIGS. 1A and 1B is substantially the same as wrap portion 120 shown in FIG. 7. The difference between wrap portion 120' and wrap portion 120, is that wrap portion 120' does not include attachment straps 132A, B nor steel rings 126A, B. Otherwise, wrap portion 120' contains the same components and is used in the same manner as wrap portion 120.

Figure 8:
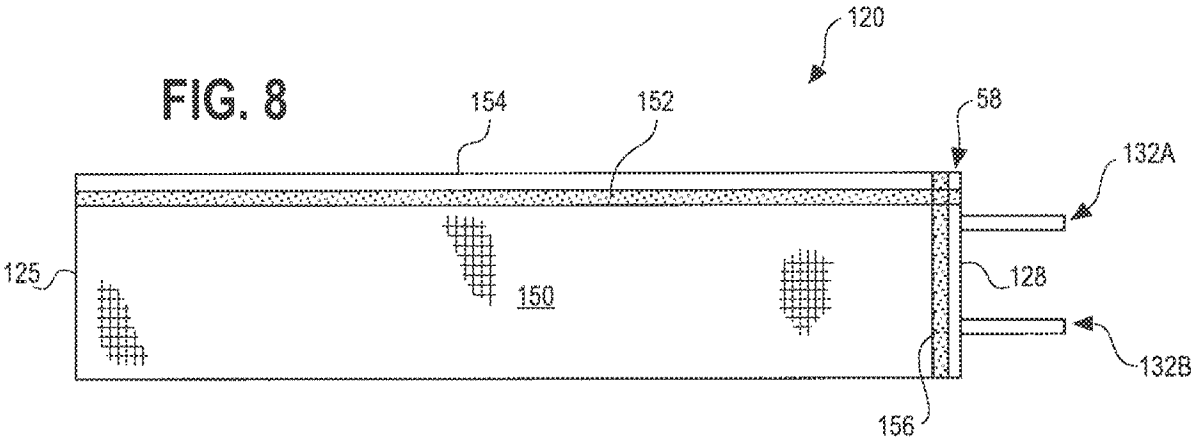
FIG. 8 is an elevational view of an interior side of the wrap portion of the covering of FIG. 7.

FIG. 8 shows the interior side 150 of the wrap portion 120. The interior side 150 contains a horizontal ribbon of hook fasteners 152 that extends the length of the wrap portion adjacent a top edge 154. The vertical ribbon of hook fasteners 156 extends down the height of the interior side 150 of the wrap portion 120 and is attached adjacent the second end portion 128. The horizontal ribbon of hook fasteners 152 is used to engage the cap portion 60, 160, 260, or 360 similar to the horizontal bands of hook fasteners 52A, B, C of the interior side 50 of the wrap portion 20. The vertical ribbon of hook fasteners 156 is used to engage one or more of the vertical strips of loop fasteners 124A, B, C on the exterior side 122 of the wrap portion 120. Furthermore, the extension of the strips and ribbons of hook and loop fasteners, 124, 152, and 156, along the height and length of the interior and exterior of the wrap portion 120 enables the wrap portion 120 to be used with pallets of goods of varying heights, widths, and lengths.

Figure 9:
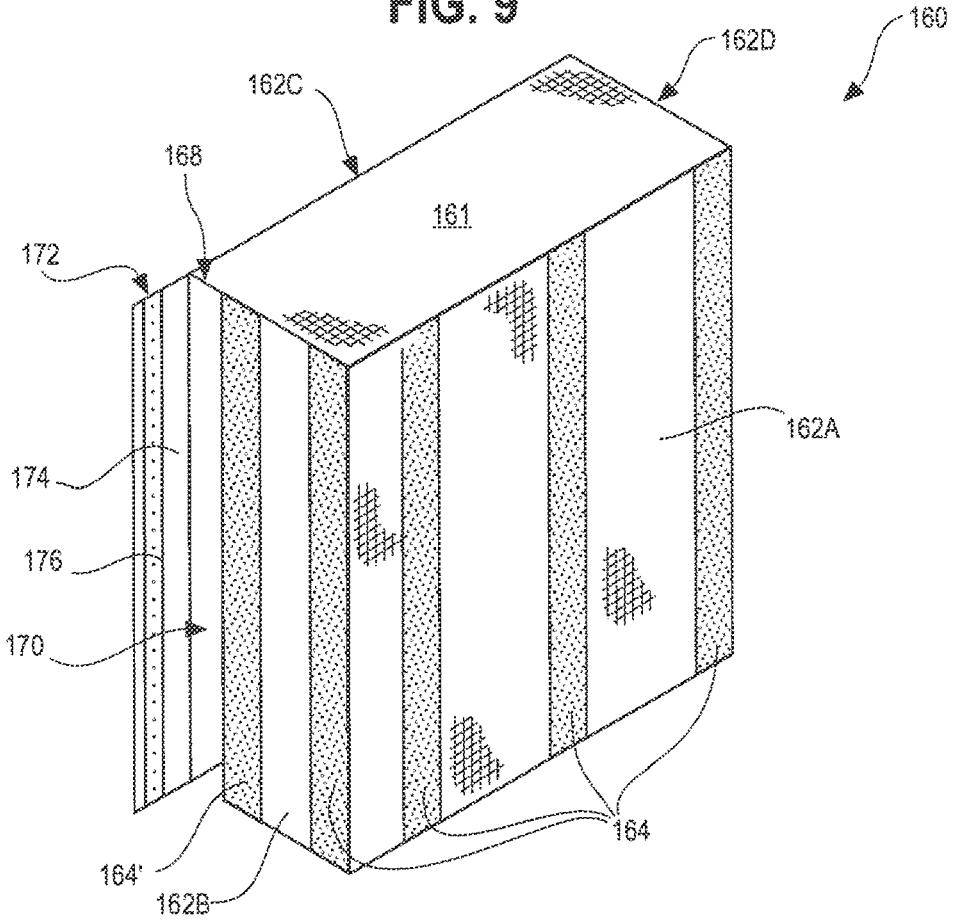
FIG. 9 is an isometric view of another embodiment of a cap portion of the covering.

FIG. 9 shows another embodiment of the covering 18 having a cap portion 160. The cap portion 160 has a top 161 and four sides 162A, B, C, D (side 162C is a mirror image of side 162A and side 162D is substantially a mirror image of side 162B). A plurality of vertical stripes of loop fasteners 164 extend the height of the cap portion 160 and are located on each side 162A, B, C, D of the cap portion 160 at varying distances from each other. In addition, one side of the cap portion 160 may include a pocket with a transparent window similar to the pocket 48 and transparent window 49 discussed above. Furthermore, on a portion 168 of side 162B is an opening 170 and flap 172. The inside portion 174 of the flap 172 has a vertical stretch of loop fasteners 176 that engages vertical stripe 164', which is adjacent to the opening 170. The opening 170 is provided to enable easier mounting of the cap portion 160 on a pallet of stacked goods. The plurality of vertical strips of loop fasteners 164 engage one or more of the horizontal bands of hook fasteners 52 disposed on the interior side 50 of the wrap portion 20 or horizontal ribbon of hook fasteners 152 of the wrap portion 120 or 120' when the wrap portion is wrapped around the pallet of stacked goods thereby securing the wrap portion 20, 120, or 120' to the cap portion 160.

Figure 10:
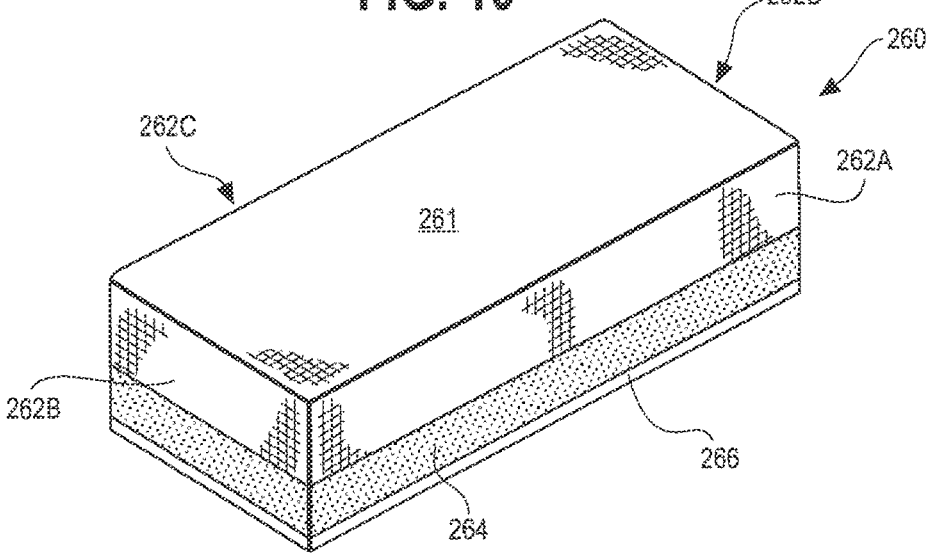
FIG. 10 is an isometric view of a further embodiment of a cap portion of the covering.

FIG. 10 shows a further embodiment of the covering 18 having a cap portion 260. The cap portion 260 has a top 261 and four sides 262 A, B, C, D (side 262C is a mirror image of side 262A and side 262D is a mirror image of side 262B). A horizontal belt of loop fasteners 264 is attached adjacent a bottom edge 266 around all four sides 262 A, B, C, D of the cap portion 260. The horizontal belt of loop fasteners 264 engages one of the horizontal strips of hook fasteners 52A, B, or C disposed on the interior side 50 of the wrap portion 20 or horizontal ribbon of hook fasteners 152 of the wrap portion 120 when the wrap portion is wrapped around the pallet of stacked goods thereby securing the wrap portion 20, 120, or 120' to the cap portion 260.

FIGS. 1A and 1B show another embodiment of the covering 18 having a cap portion 360. The cap portion 360 has a top 361 and four sides 362A, B, C, D (side 362C is a mirror image of side 362A and side 362D is substantially a mirror image of side 362B). A plurality of vertical stripes of loop fasteners 364 extend the height of the cap portion 360 and are located on each side 362A, B, C, D of the cap portion 360 at varying distances from each other. In addition, side 362B of the cap portion 360 may include a pocket 48 with a transparent window 49. Furthermore, on a portion 368 of side 362B is an opening (not shown) and a flap 372. The inside portion (not shown) of the flap 372 has a vertical stretch of loop fasteners that engages a vertical stripe 364' on the exterior of side 362B, which is adjacent to the opening. The opening is provided to enable easier mounting of the cap portion 360 on a pallet of stacked goods. The plurality of vertical strips of loop fasteners 364 engage or horizontal ribbon of hook fasteners 152 of the wrap portion 120' (or 120) or one or more of the horizontal bands of hook fasteners 52 disposed on the interior side 50 of the wrap portion 20 when the wrap portion is wrapped around the pallet of stacked goods thereby securing the wrap portion 20, 120, or 120' to the cap portion 360.

Various materials that are strong, durable, and flexible may be used to form the wrap portions 20, 120, and 120' and cap portions 60, 160, 260, and 360. For example, in one embodiment four layers of material are enclosed by a fabric. The first layer consists of a material such as a coated textile that is impermeable to moisture and air, the second layer consists of a thermal insulated material for example a nanofiber or microweave fabric, the third layer consists of a polyester filler material, and the fourth layer consists of a fabric such as coated denier fabric, nylon, polyester, vinyl, nanofiber, or microweave fabric. One of ordinary skill in the art would understand that any materials that serve the same purpose as those mentioned above may be used. Stitching at the ends of the layers keeps them from moving within the enclosing fabric.

Another embodiment contains five layers consisting of the same materials mentioned above that are held together by stitching through a fabric binding at the ends of the layers. The first layer consists of fabric, the second layer consists of a polyester filler, the third layer consists of a thermal insulated material, the fourth layer consists of a polyester filler, and the fifth layer consists of a material that is impermeable to moisture and air. Another embodiment consists of three layers, the first being fabric, the second being polyester filler, and the third layer being fabric.

Figure 11:
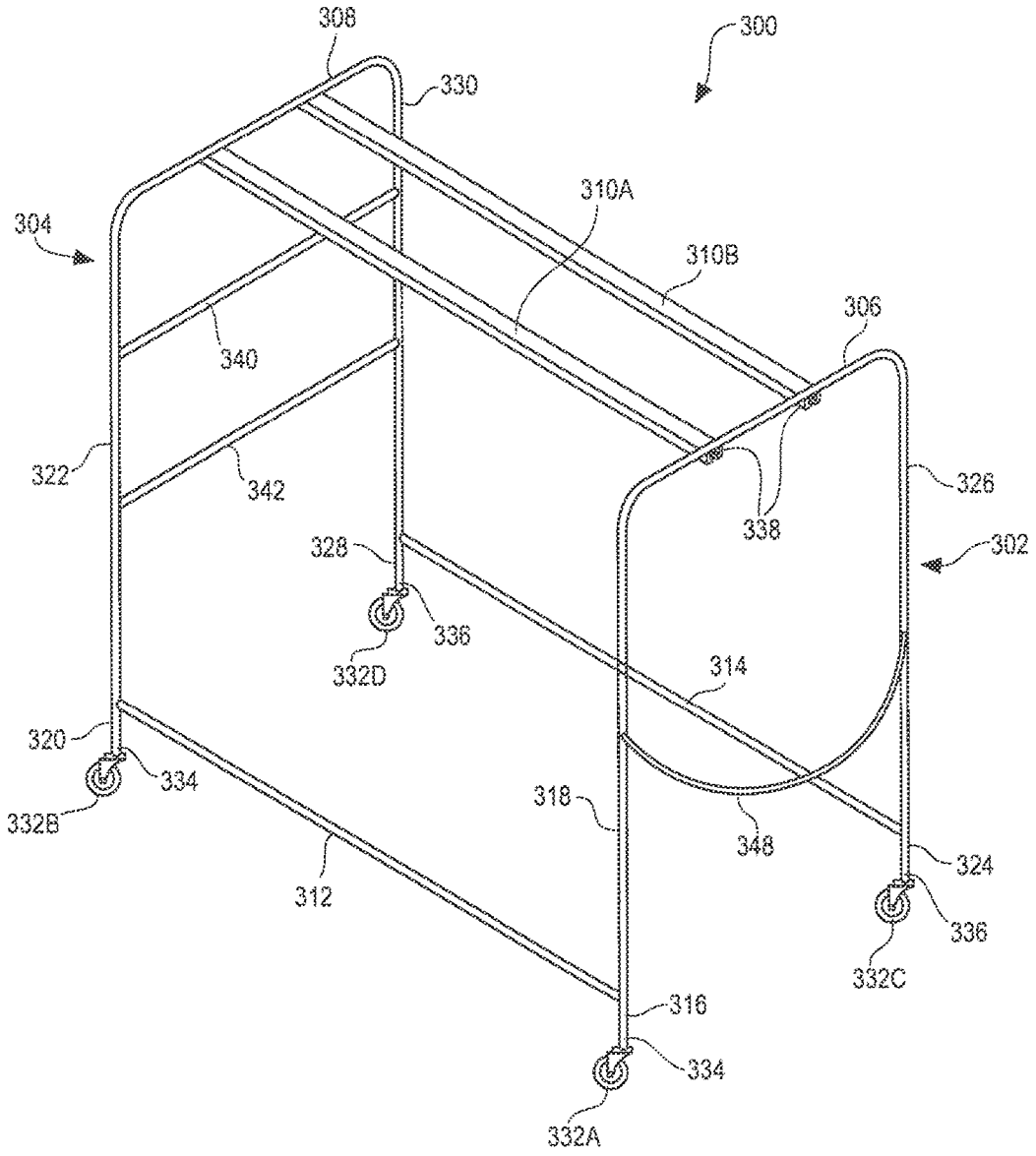
FIG. 11 is a isometric view of a storage rack.

FIGS. 11-16 show different views of a storage rack upon which the coverings 18 are stored. Turning to FIG. 11, a storage rack 300 has a first frame member 302 and a second frame member 304. Both the first frame member 302 and the second frame member 304 are shaped, in one embodiment, like an upside down "U" and have cross bar member 306 and 308, respectively. The frame members can have any suitable shape without departing from the spirit and scope of the invention (e.g., the frame members could have square corners rather than curved or rounded corners). The first frame member 302 is connected to the second frame member 304 by a pair of tracks 310A, B, which are attached to an underside of each of crossbar members 306 and 308 and are substantially parallel to each other. The first frame member 302 is also connected to second frame member 304 by a first support bar 312 and second support bar 314. The first support bar 312 is attached at one end to a lower portion 316 of a first arm 318 of the first frame member 302 and at the other end to a lower portion 320 of a first arm 322 of the second frame member 304. The second support bar 314 is attached at one end to a lower portion 324 of a second arm 326 of the first frame member 302 and at the other end to a lower portion 328 of a second arm 330 of the second frame member 304.

Wheels 332A, B are attached to lower ends 334 of the first arms 318, 322, respectively, and 332C, D are attached to lower ends 336 of the second arm 326, 330 of the respective first and second frame members. The wheels 332A, B, C, D have locks to prevent the storage rack 300 from moving when a covering 18 is being removed from or placed onto the storage rack. Alternatively, the storage rack 300 may contain a separate braking mechanism to prevent movement of the storage rack during the loading and unloading of the covering 18 from the storage rack 300.

Figure 12:
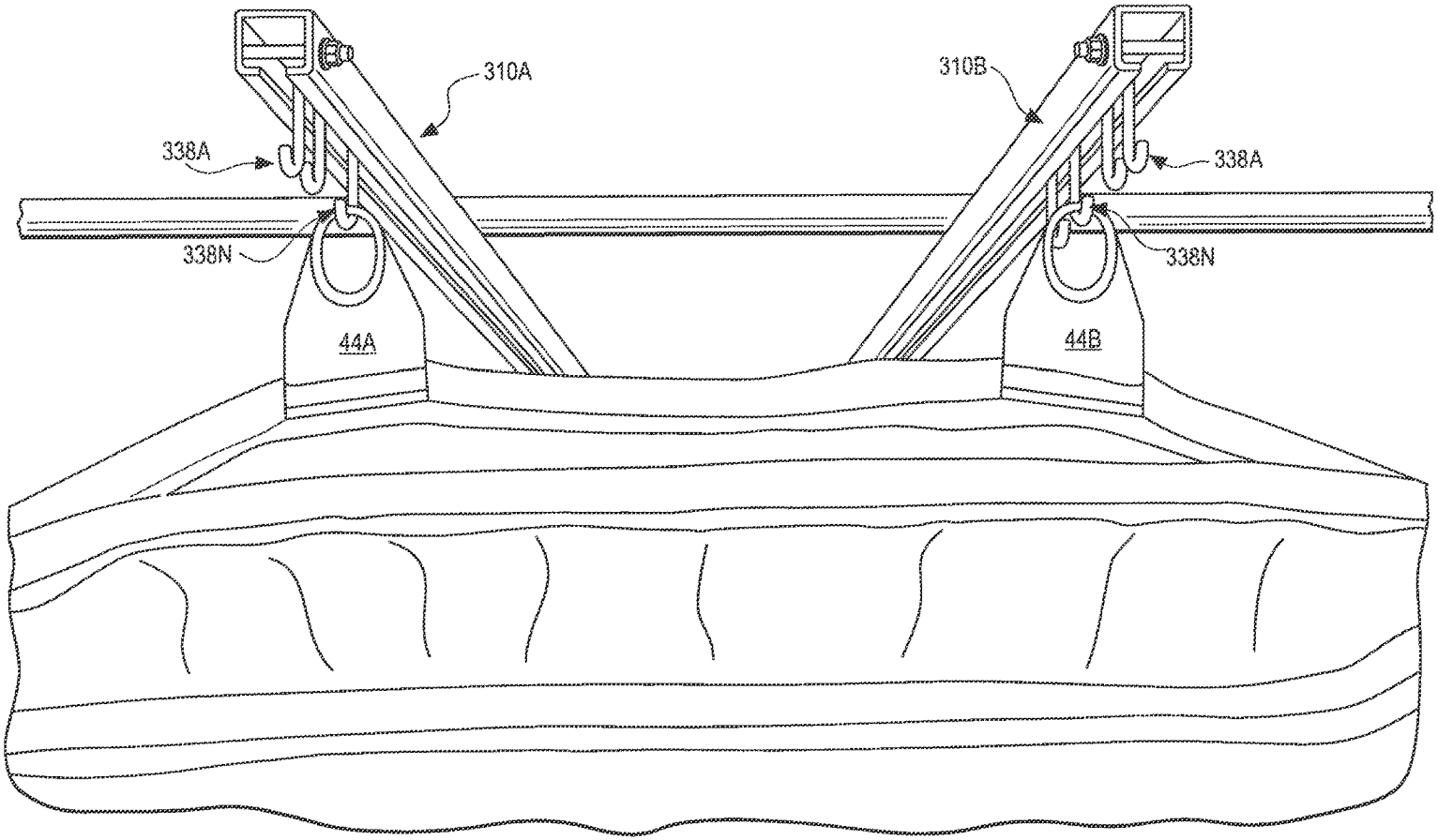
FIG. 12 is a partial front elevational view of a wrap portion hung on a storage rack.
Figure 13:
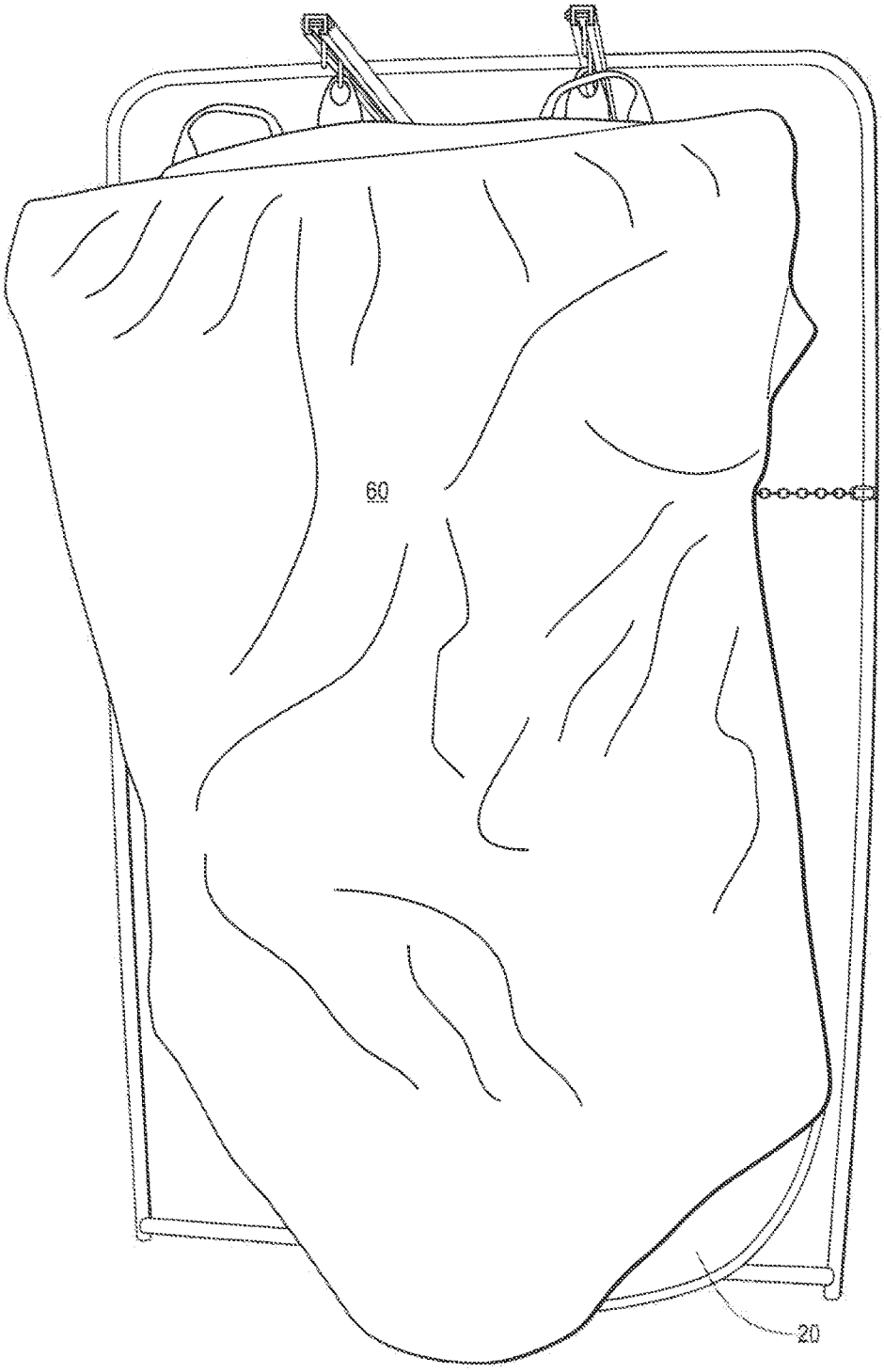
FIG. 13 is a front elevational view of a wrap portion of the covering hung on a storage rack and a cap portion attached to the wrap portion.

Turning to FIG. 12, each track 310A and 310B also contains movable storage hooks 338A-N. The same number of movable storage hooks 338A-N are provided on each track 310A, B because each covering 18 requires the use of two storage hooks to be properly hung. When a covering 18 is to be hung on the storage rack, the wrap portion 20, for example, is first folded about the exterior side 22 several times (discussed below) thereby exposing a portion of the interior side 50. The wrap portion 20 is then hung on the storage rack 300 by placing plastic loop 44A on a movable storage hook 338 contained on one of the tracks 310 and loop 44B on a corresponding movable storage hook 338 contained on the other track. The cap portion 60, 160, 260, or 360 is then attached to the wrap portion 20 by mating loop fasteners portions of the cap portion, i.e., 64, 164, 264, and 364 of cap portions 60, 160, 260, and 360, respectively, with the horizontal band of hook fasteners 52A of the interior side of the wrap portion 20 (see FIG. 13).

In addition, a first location or storage facility may contain stationary tracks that are used to store the covering 18 when it is not being used. These stationary tracks can be attached to or mated with the tracks 310A, B in a manner that enables the movable storage hooks 338 to travel from the stationary tracks to the tracks 310A, B and vice versa without interruption. This arrangement increases efficiency by eliminating the need to unhook the covering 18 from the storage hooks 338 on the storage rack 300 and place them on separate hooks hanging from the stationary tracks.

As shown in FIG. 11, the second frame member 304 also comprises two confinement bars 340 and 342. The two confinement bars 340, 342 prevent the coverings 18 from extending beyond the plane created by the three sides of the second frame member 304 thereby preventing the coverings from swinging or moving about while the storage rack 300 is being moved or if too many coverings 18 are placed on the storage rack.

Figure 14:
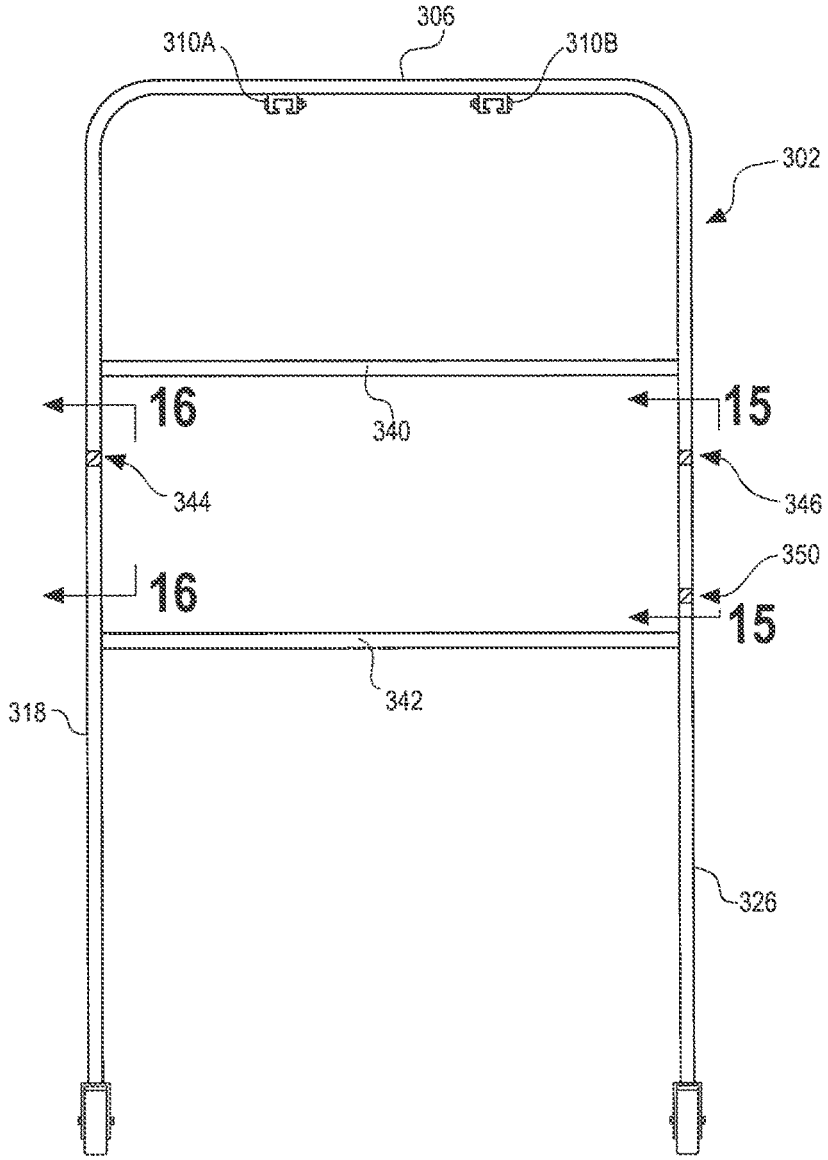
FIG. 14 is a front elevational view of the storage rack of FIG. 11.
Figure 15:
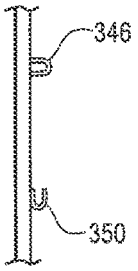
FIG. 15 is a right side view of a portion of the storage rack taken along the lines 15-15 of FIG. 14.

Turning to FIG. 14, the first frame member 302 also contains attachment members 344 and 346. The attachment members 344, 346 may be any other suitable attachment mechanism such as a D-ring (see FIG. 15) and are drilled into or soldered onto the first and second arms 318, 326, respectively, of the first frame member 302 at the same height. The attachment members 344, 346 enable a chain 348 (see FIG. 11) to be attached to and extend between the first and second arms 318, 326, respectively, of the first frame member 302. The chain 348 may be fixed to one attachment member and removably attached to the other, or the chain 348 may be removably attached to both attachment members 344, 346. The chain 348 keeps the coverings 18 between the first and second frame members 302, 304, respectively. By confining the coverings 18 between the two frame members, movement of the storage rack is easier and more efficient as the coverings 18 are not moving or swinging about. When the coverings 18 are to be placed on a pallet of stacked goods, the chain 348 is removed from one or both of the attachment members to enable efficient removal of the coverings 18 from the storage rack 300.

Figure 16:
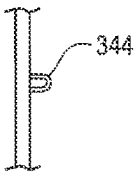
FIG. 16 is a right side view of a portion of the storage rack taken along the lines 16-16 of FIG. 14.

The second arm 326 of the first frame member 302 also contains a pull-cord hook 350, which may be any suitable shape, for example, J-shaped (see FIG. 16). The pull cord hook 350 drilled into or soldered onto the second arm 326 of the first frame member 302. The pull cord 350 allows for storage of the pull cord 70 so that it is not lost or misplaced after the coverings 18 have been placed on the pallet of stacked goods.

To use the covering 18 on a pallet of stacked goods that is to be shipped, a user first locates a storage rack 300 that has cap portion 60 and wrap portion 20 of covering 18 stored on it at a first location (e.g., warehouse). Although the method is discussed in terms of a single covering 18, the rack may contain multiple coverings that can be used to cover multiple pallets of goods. If the pallet of stacked goods is of a small or medium height, the user removes the cap portion 60 from the wrap portion 20 and places it on the top of the goods located on a pallet. If the pallet of stacked goods is tail, the user moves the storage rack close to the pallet of stacked goods to be covered, e.g., within two to three feet of the pallet of stacked goods. The user then attaches the pull cord 70, which is stored on pull cord hook 350 of the storage rack, to the pull cord loop 68 of the cap portion 60. The pull cord 70 is then thrown over the top of the pallet of stacked goods. The user then walks around the pallet of stacked goods to where the pull cord 70 has fallen, picks up the pull cord 70, and pulls the pull cord 70. When the user pulls the pull cord 70, the cap portion 60 detaches from the wrap portion 20 which is hanging from the storage hooks 338 of the storage rack 300. The user then positions the cap portion 60 on top of the goods. Once the cap portion 60 is properly placed on the pallet of stacked goods, the pull cord 70 is removed from the pull cord loop 68 and placed back on pull cord hook 350.

The wrap portion 20 is then removed from the storage rack 300. The interior side 50 of the wrap portion is placed adjacent the goods on the pallet with first end portion 25 being aligned with one edge of the pallet of stacked goods. One of the horizontal bands of hook fasteners 52A, B, or C of the interior side 50 of the wrap portion 20 is first attached to the loop fastener portion 64A of the cap portion 60, then attached to the loop fastener portions 64B, 64C, and 64D, in that order. Depending on what cap embodiment is used (i.e., 60, 160, 260, or 360), the horizontal bands of hook fasteners 52 may engage vertical stripes of loop fasteners 164, 364 of cap portion 160, 360, respectively, or horizontal belt of loop fasteners 264 of cap portion 260. The user then unfolds the wrap portion 20 as he walks around the pallet of stacked goods and continues to mate the horizontal band of hook fasteners 52 of the wrap portion 20 with loop fastener portions 64B, 64C, and 641) of the cap portion 60, in that order. When the user has completely covered all four sides of the pallet of stacked goods, the user then folds the remaining portion or flap 58 of the wrap portion 20 over the first side of the pallet of stacked goods so that the vertical band of hook fasteners 56 of the interior side 50 engages the vertical strip of loop fasteners 24 of the exterior side 22, thereby securing the wrap portion 20 around the goods.

After the wrap portion 20 is securely attached to the cap portion 60, a user may then lift the bottom portion 38 of the wrap using one of the pairs of lift straps 30 or 32. As mentioned above, the tab 42 of the lift straps are lifted up and mated with attachment portion 40. A forklift can then be used to pick up the pallet of stacked goods and place it on a delivery vehicle for shipment to a second location e.g., distribution center or retail store.

Once the wrapped goods have been moved from the first location to the second location the covering 18 is removed. To remove the covering 18 the flap 58 is detached from the vertical loop strip 24 of the wrap portion 20. The exterior side 22 of the wrap portion 20 is then folded about itself. The first fold occurs by bring the second end portion 57 near an edge of the pallet of stacked goods below the intersection of the third and fourth sides 62C and 62D, respectively, of the cap portion 60 (see FIG. 5). As the user is folding the exterior side 22 about itself, the horizontal band of hook fasteners 52A, B, or C are being detached from the loop fastener portions 64, 164, 264, or 364 of the cap portion 60, 160, 260, or 360, respectively. The second fold occurs by bringing the first fold near an edge of the pallet of stacked goods below the intersection of the second and third sides 62B and 62C, respectively, of the cap portion 60. The third fold occurs by bringing the second fold near an edge of the pallet of stacked goods below the intersection of the first and second sides 62A, and 62B, respectively, of the cap portion 60. And the fourth fold occurs by aligning the third fold with the first end portion 25. By wrapping the wrap portion 20 in this manner, the interior side 22, particularly horizontal bands of hook fasteners 52, of the wrap portion 20 is exposed. The user than grasps all the folds and lifts the wrap portion 20 away from the pallet of stacked goods, thereby detaching the last portion of the horizontal bands 52A, B, or C from the cap portion 60.

Once the folding is completed, the user moves the folded wrap portion 20 to the storage rack 300. There the user positions the folded wrap on the storage rack 30 such that the plastic hook 44A is engaged with storage hook 338 on track 310A and the plastic hook 44B is engaged with corresponding storage hook 338 on track 310B, or vice versa.

Next the cap portion 60 is removed from the pallet of stacked goods. If the pallet of stacked goods is tall, the user pushes side 62A up so that side 62C is lowered. The user than grasps the handles 72A, B and pulls the cap portion 60 off the pallet of stacked goods. The user then aligns upper edge 74 of the cap portion 60 with top edge 46 of the folded wrap portion 20 so that the hook fastener portion 64C engages the horizontal band of hook fasteners 52A. Although any hook fastener portion 64 can be attached to any horizontal band of book fasteners 52, the most efficient storage of the cap portion 60 and wrap portion 20 is by mating the hook fastener portion 64C with the horizontal band of hook fasteners 52A. If a storage rack 300 is not present at the second location, then the wrap and cap portions of the covering 18 may be hung or stored on hooks contained in the delivery vehicle. Assuming that a storage rack 300 is present at the second location, the storage rack 300 with the stored coverings 18 is then placed back into the delivery vehicle and transported back to the first location or to a third location e.g., an inspection facility. The coverings 18 may also be inspected by a user for cleanliness or damage. The inspection may take place at the first location, the second location, or a third location.

The specific design of the various cap portions 60, 160, 260, and 360, wrap portion 20, 120, and 120', and the storage rack 300 mentioned above enable a single user to efficiently remove or place a covering on a pallet of stacked goods that is short, medium, or tall without the help of another or having to use a ladder, chair or other elevation device. This provides for more efficient preparation and shipping of goods as less time is needed to prepare and deliver the pallet of stacked goods.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A method of preparing stacked goods for transport, comprising the steps of:

providing a covering for the stacked goods including a wrap portion removably carried by a storage rack and a cap portion removably attached to the wrap portion wherein the cap portion includes an attachment member, wherein the cap portion has a top and a plurality of sides extending from the top of the cap portion, wherein first fasteners are disposed on an outside surface of the cap portion, wherein second fasteners are disposed on a horizontal band on an inside surface of the wrap portion;

securing a force transmission member to the attachment member;

removing the cap portion from the wrap portion;

moving the force transmission member to position the cap portion atop the stacked goods;

removing the wrap portion from the storage rack;

wrapping the wrap portion around the stacked goods and at least a portion of the plurality of sides of the cap portion in accordance with a size of the stacked goods, wherein the wrap portion is adjustable for wrapping around stacked goods of varying lengths and widths; and securing the wrap portion around the cap portion such that the plurality of sides of the cap portion are, at least, partially nested within the wrap portion, wherein the first fasteners are removably attachable to the second fasteners to fit stacked goods of varying vertical heights.

2. The method of claim 1, wherein the force transmission member is a cord, and wherein the step of securing a force transmission member comprises the step of removing the cord from the storage rack and attaching the cord to the attachment member using a clasp, and wherein the cord is removably carried by the storage rack.

3. The method of claim 2, wherein the step of moving the force transmission member comprises the step of throwing the cord over the stacked goods and pulling the cord to position the cap portion atop the stacked goods.

4. The method of claim 2, wherein the step of providing includes the step of suspending the wrap portion on movable storage hooks carried by the storage rack, wherein the movable storage hooks hang from two horizontal tracks that extend between a first frame member and a second frame member of the storage rack.

5. The method of claim 2, wherein the step of providing includes the step of removing the cord from a hook mounted on the storage rack.

6. The method of claim 5 further comprising the step of removing the cord and hanging the cord on the hook mounted on the storage rack.

7. The method of claim 1, wherein the second fasteners are disposed on one or more horizontal bands disposed on the inside surface along a top edge of the wrap portion.

8. The method of claim 7, wherein the first fasteners of the cap portion and the second fasteners of the wrap portion comprise hook and loop fasteners, and wherein the cap portion is adapted to be fully nested within the wrap portion when the vertical height of the stacked goods less than a height of the top edge of the wrap portion.

9. The method of claim 1, wherein the wrap portion comprises third fasteners disposed on vertical bands disposed on an outside surface of the wrap portion and fourth fasteners disposed on straps disposed on the outside surface of the wrap portion.

10. The method of claim 1, wherein the step of providing comprises the step of supplying a plurality of wrap portions removably carried by the storage rack and a plurality of cap portions each removably secured to one of the wrap portions, wherein the storage rack can be wheeled near stacked goods and locked in place to prevent the storage rack from moving when the covering is removed from or placed onto the storage rack.

11. The method of claim 1, wherein the cap portion and the wrap portion are thermal insulated, and wherein the cap portion has four sides and the cap portion comprises a pocket with a transparent window disposed on an exterior of one of the four sides.

12. The method of claim 1, wherein one or more lift straps are attached to a lower area of the wrap portion, the lift straps having a first portion of a hook and loop fastener and a second portion of a hook and loop fastener; the method further comprising the step of raising the first portion of the hook and loop fastener to engage the second portion of hook and loop fasteners thereby raising the lower area of the wrap portion.

13. The method of claim 12, wherein the stacked goods are stacked upon a pallet, further comprising the steps of:

positioning a fork of a forklift under the lower area of the wrap portion;

engaging the pallet upon which the stacked goods are stacked; and moving the pallet of stacked goods.

14. A method of preparing stacked goods for transport, comprising the steps of:

obtaining a covering comprising a thermally insulated cap portion and wrap portion at a first location, wherein the cap portion has a top and a plurality of sides extending from the top of the cap portion, wherein first fasteners are disposed on an outside surface of the cap portion, and wherein second fasteners are disposed on a horizontal band on an inside surface of the wrap portion, and wherein the wrap portion is adjustable for wrapping around stacked goods of varying sizes;

installing the covering on the stacked goods, wherein the step of installing comprises positioning the cap portion atop the stacked goods and wrapping the wrap portion around the stacked goods and at least a portion of the plurality of sides of the cap portion in accordance with a length and a width of the stacked goods such that the plurality of sides of the cap portion are, at least, partially nested within the wrap portion, wherein the top is positioned in a generally horizontal orientation and the plurality of sides of the cap portion are positioned in a generally vertical orientation, and wherein the first fasteners are removably attachable to the second fasteners to fit stacked goods of varying vertical heights;

transporting the stacked goods with the installed covering to a second location;

removing the covering from the stacked goods;

placing the covering on a storage rack; and transporting the covering and storage rack to the first location.

15. The method of claim 14, further comprising the step of inspecting the covering for damage and cleanliness.

16. The method of claim 14, wherein the storage rack comprises a first frame member, a second frame member, and two parallel track portions that extend horizontally from the first frame member to the second frame member.

17. The method of claim 16, wherein the storage rack includes at least two movable storage hooks that hang from the two parallel track portions.

18. The method of claim 17, wherein the step of removing further comprises the steps of:

hanging the folded wrap portion on the at least two movable storage hooks via a set of eyelets on the wrap portion; and attaching the cap portion to the wrap portion wherein the first fasteners and the second fasteners are hook and loop fasteners.

19. The method of claim 14, wherein the storage rack is mounted on four wheels, each of the wheels having a lock such that the transporting step can be performed by one person.

20. The method of claim 14, wherein the cap portion has four sides, and wherein the step of installing further comprises securing the wrap portion and cap portion together, wherein the first fasteners and the second fasteners are hook and loop fasteners, and wherein the cap portion is adapted to be fully nested within the wrap portion.

21. The method of claim 14, wherein the step of removing further comprises the steps of:

unwrapping the wrap portion from the stacked goods;

folding the wrap portion in a manner to enable storage; and removing the cap portion from the stacked goods.

22. The method of claim 21, wherein the step of removing further includes the steps of:

pushing a first end of the cap portion on top of the stacked goods;

grasping a pair of handles attached to a first seam and a second seam forming a second end of the cap portion, substantially opposite the first end; and pulling the pair of handles such that the cap portion is pulled off of and away from the stacked goods.

* * * * *